US010668993B2

(12) United States Patent
Saevitz

(10) Patent No.: US 10,668,993 B2
(45) Date of Patent: Jun. 2, 2020

(54) FOOT BINDING ASSEMBLY FOR STANDUP PADDLEBOARDS

(71) Applicant: Ryan Alexander Saevitz, Needham, MA (US)

(72) Inventor: Ryan Alexander Saevitz, Needham, MA (US)

( * ) Notice: Subject to any disclaimer, the term of this patent is extended or adjusted under 35 U.S.C. 154(b) by 0 days.

(21) Appl. No.: 16/101,108

(22) Filed: Aug. 10, 2018

(65) Prior Publication Data

US 2019/0054984 A1 Feb. 21, 2019

Related U.S. Application Data

(60) Provisional application No. 62/547,758, filed on Aug. 19, 2017.

(51) Int. Cl.
*B63B 35/79* (2006.01)
*B63B 7/08* (2020.01)

(52) U.S. Cl.
CPC ..... *B63B 35/7936* (2013.01); *B63B 35/7909* (2013.01); *B63B 35/7913* (2013.01); *B63B 35/7993* (2013.01); *B63B 7/082* (2013.01); *B63B 35/7926* (2013.01); *B63B 35/7946* (2013.01)

(58) Field of Classification Search
CPC ..... B63B 35/7936; B63B 35/7909; B63B 35/7913; B63B 35/7993; B63B 35/7926; B63B 7/082
See application file for complete search history.

(56) References Cited

U.S. PATENT DOCUMENTS

2012/0108119 A1* 5/2012 Foster ..... B63B 35/7936 441/74
2014/0017963 A1 1/2014 Lazarovits

FOREIGN PATENT DOCUMENTS

WO WO-9613308 A1 * 5/1996 ..... A63C 17/0006

* cited by examiner

*Primary Examiner* — Stephen P Avila
(74) *Attorney, Agent, or Firm* — McCoy Russell LLP

(57) ABSTRACT

A stand-up paddleboard (SUP) may be configured with a non-retentive binding system to secure a user's foot positioning. In one example, the binding system may include pockets formed from panels extending continuously along edges of the paddleboard, and straps to provide tension on the pockets, to reduce a likelihood of undesired sliding of the user's feet. The pockets of the binding system may allow the user to reposition the user's feet to multiple secured footholds within the binding system, thereby allowing the user's stance and balance to be maintained.

19 Claims, 11 Drawing Sheets

FOOT BINDING ASSEMBLY FOR STANDUP PADDLEBOARDS

CROSS REFERENCE TO RELATED APPLICATIONS

The present application claims priority to U.S. Provisional Application No. 62/547,758, entitled "Standup Paddleboard Foot Bindings Assemblies", and filed on Aug. 19, 2017. The entire contents of the above-listed application are hereby incorporated by reference for all purposes.

FIELD

The present description relates generally to methods and systems for securing foot placement on a watersport apparatus.

BACKGROUND AND SUMMARY

The use of watercrafts where a user is standing upright on an upper surface of a floating board, such as a stand-up paddleboard or SUP, has become a popular recreational activity. Stand-up paddling may be performed under a variety of conditions, lending to its widespread appeal and participation from a wide range of demographics. Modern stand-up paddling, whether applied to surfing ocean waves or rivers, paddling distances across still bodies of water, or fishing from atop the SUP, originates from the Hawaiian Islands. The legendary Duke Kahanamoku was one of the pioneers of the sport, standing on his surfboard and using a paddle to steer the board in order to gain better views of incoming swells. Since then, stand-up paddling has evolved into a sport enjoyed by surfers and nonsurfers alike and many advances in equipment options and features as well as paddleboard construction have emerged over the last decade.

Modern stand-up paddleboard equipment includes a large SUP that may be formed from a variety of materials including polyurethane or polystyrene foam cores surrounded by a fiberglass or epoxy shell. Alternatively, the SUP may be formed from a plastic such as polypropylene or polyethylene with a soft upper surface. In other examples, the SUP may be inflatable and made from a combination of rubber, PVC, urethane, and polymer, or from a drop stitch material. The SUP may be steered by the user via a paddle held in the hands of the user and formed from fiberglass, wood, carbon fiber, aluminum, or plastic.

In calm waters, the SUP may be configured to be long and wide, relative to a size of the user, to provide stability so that the user may maintain balance while standing or sitting on top of the SUP easily. However, with SUPs used for more rigorous applications, such as surfing waves or traveling along a river with rapids, a width of the SUP, and in some examples also a length, may be reduced to allow more efficient steering and navigation. The reduction in width may result in a loss of stability and adjustments of the user's positioning on the SUP to compensate for the reduced stability may be desired to maintain the user's balance and improve control of the SUP's movement. In particular, a wider stance may be adopted by the user to spread a center of mass of the user. In active waters, however, when the user's feet approach side edges of the SUP, a likelihood that the user's feet may slide off the side edges is increased due to turbulent motion of the SUP as well as loss of traction resulting from water spraying across the upper surface of the SUP.

One example approach to address the sliding of a user's feet on a SUP surface includes adapting the upper surface with devices to retain a position of the user's feet. One such approach is shown by Lazarovits in U.S. 2014/0017963. Therein, a SUP includes foot securing devices that have a concave configuration in the upper surface of the SUP, adapted with a padded surface under the user's feet within the foot securing devices. The foot securing devices may include straps extending across tops of the user's feet to constrain a position of the feet within the foot securing devices. The devices may generally conform to a shape of the user's feet and secure the feet in a single, fixed position on the upper surface of the SUP.

However, the inventors herein have recognized potential issues with such systems. As one example, the user's feet are secured in the single position determined by the arrangement of the foot securing devices once the feet are inserted without an option to vary an orientation of the feet within the foot securing devices. If turbulent waters are encountered or adjustment of the user's weight distribution along the SUP to facilitate maneuvering of the SUP is desired, the user's feet may be shifted to other positions to maintain balance. However, adjustment of the feet to such positions may result in removal of the user's feet from the foot securing devices. A likelihood of the user's feet sliding away from targeted foot positions as well as the user falling off the SUP is thus increased.

In one example, the issues described above may be addressed by a binding system for a watercraft, comprising panels extending alongside edges of the watercraft, tensioning members interfacing respectively with the panels and adjustably tensioning the webbing, pockets respectively formed by the webbing, between the panels and a surface of the watercraft, shaped to allow a user's foot to be temporarily wedged therein and further to allow the user's foot to slide along the edges while engaged in the pockets. In this way, a user's stability and balance may be improved while standing on the watercraft.

As one example, the binding system includes panels that may be attached to side edges of the watercraft, or SUP, and wrap around the side edges to extend a distance across an upper surface of the SUP. The panels may also extend a distance along a length of the SUP and a user's feet may be placed in pockets between the panels and the upper surface of the SUP at any point along a length of the panels. Tension on the panels may be generated by configuring the binding system with straps extending along the length of the panels that may be tightened or loosened with buckles. The binding system may thus provide secured positions for foot placement that are continuous along the length of the panels, allowing the user to easily adjust positioning of the user's feet to accommodate movement of the SUP while maintaining an upright stance.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 1A-11C are shown approximately to scale

DETAILED DESCRIPTION

Figure 1A:
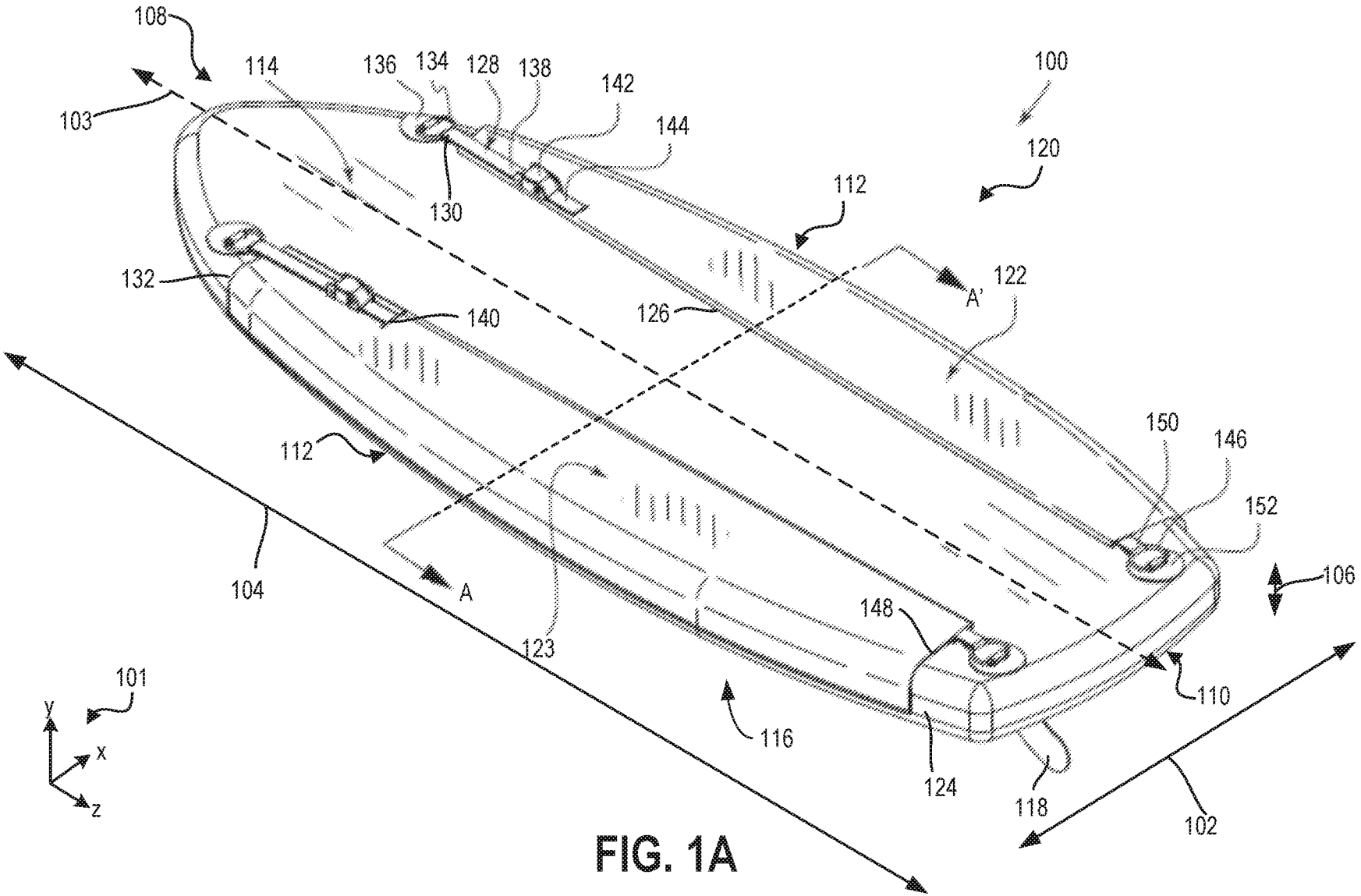
FIG. 1A is a perspective view of a first embodiment of a stand-up paddleboard (SUP) configured with a binding system for securing a user's feet.
Figure 1B:
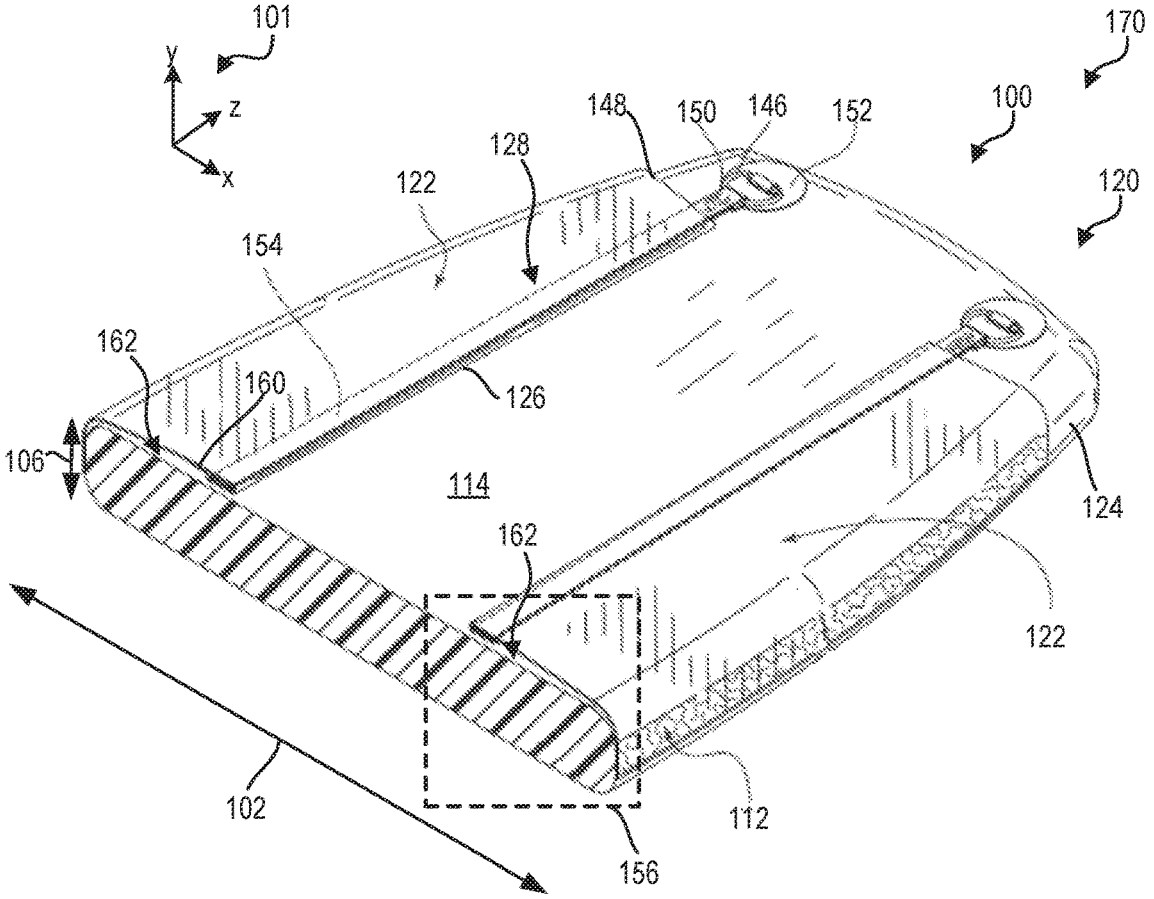
FIG. 1B is a perspective view of a cross-section of the first embodiment of the SUP.
Figure 1C:
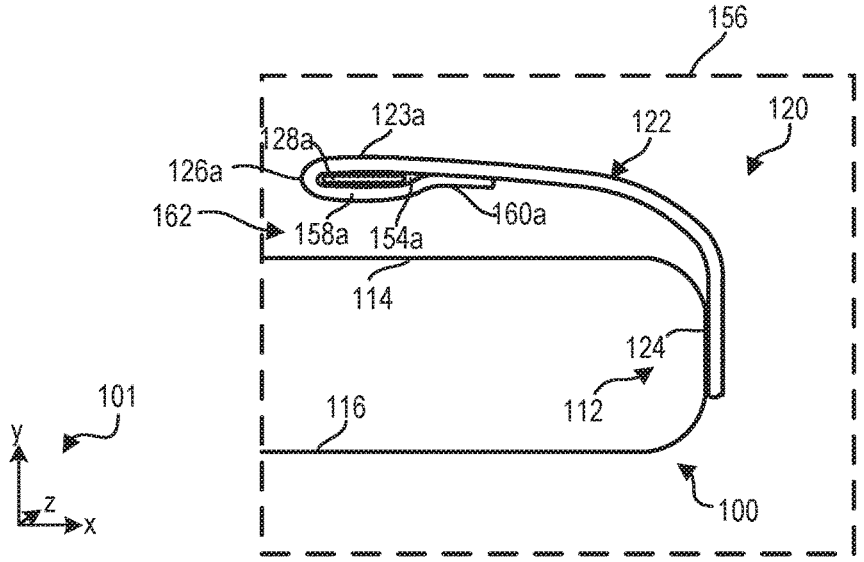
FIG. 1C is an expanded view of the cross-section of the first embodiment of the SUP.
Figure 2:
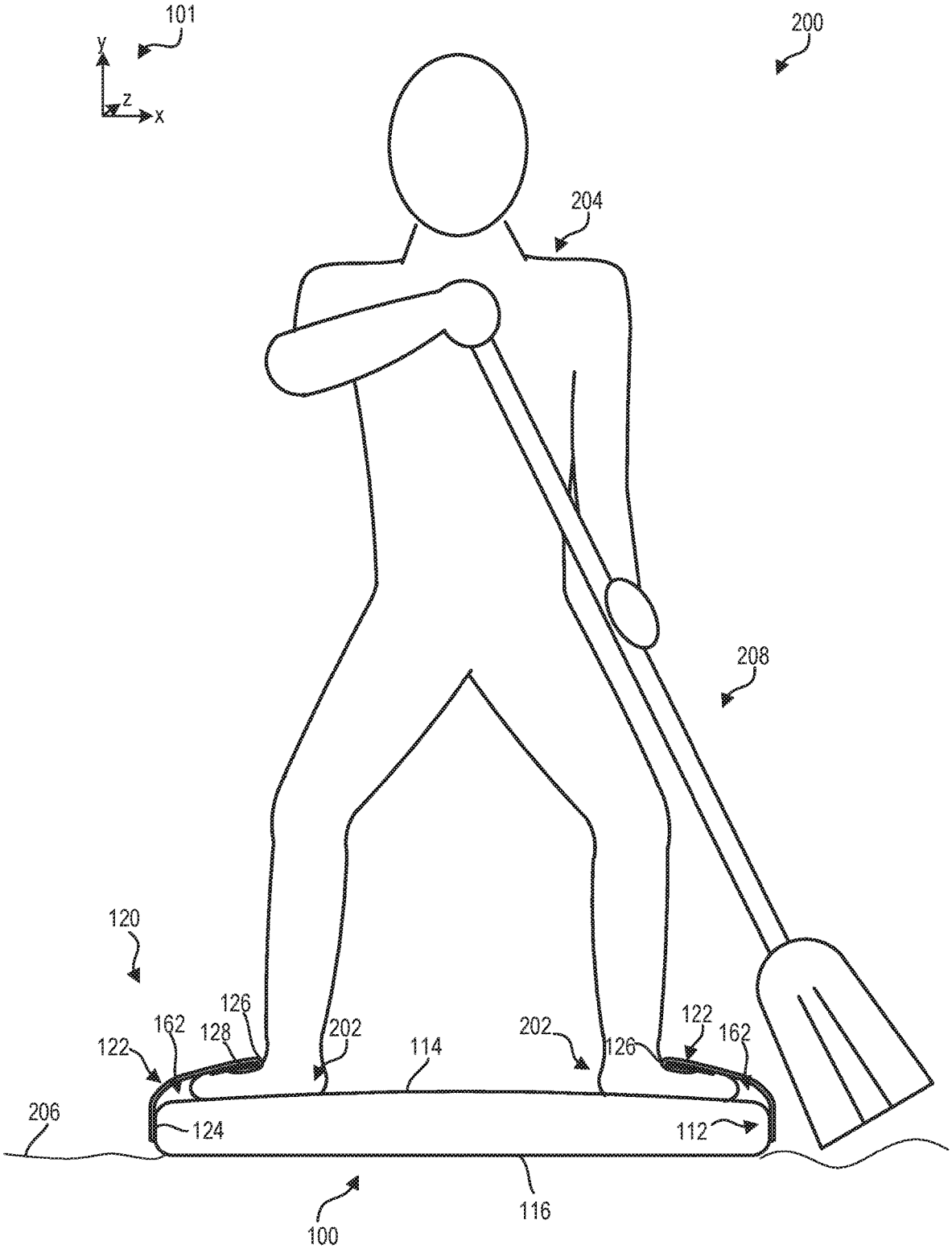
FIG. 2 shows a user standing on top of a SUP configured with a binding system with the user's feet secured by the binding system.
Figure 4:
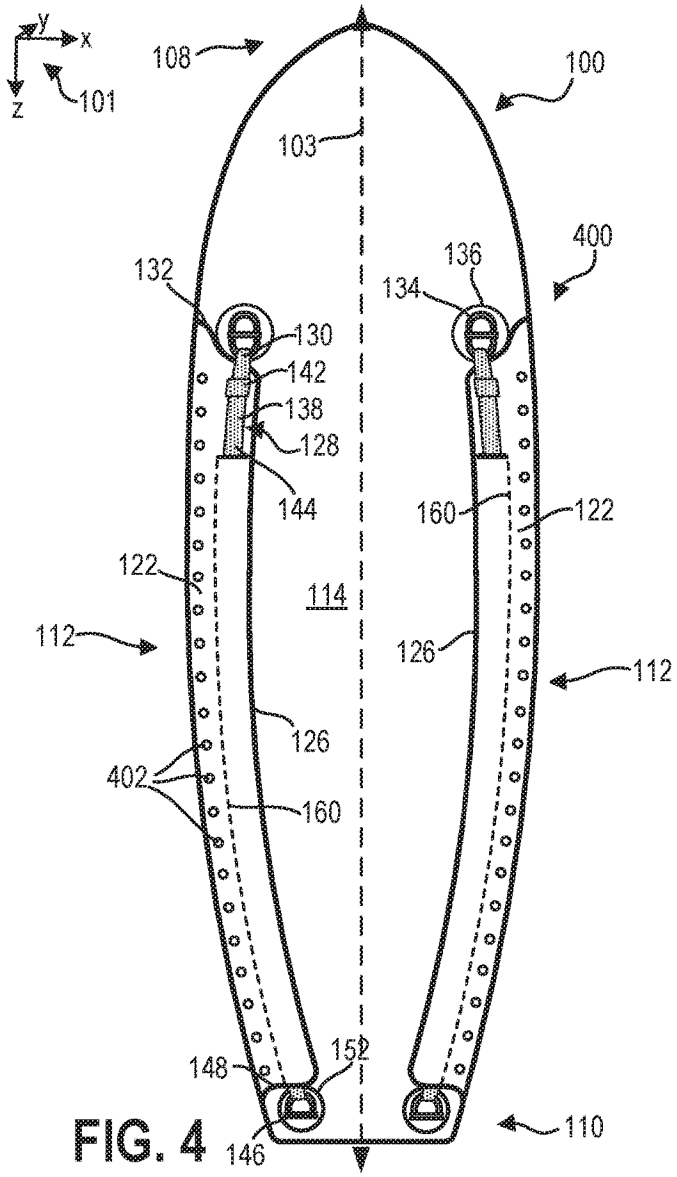
FIG. 4 is a top view of a third embodiment of a SUP with a binding system adapted with a first drainage system.
Figure 3:
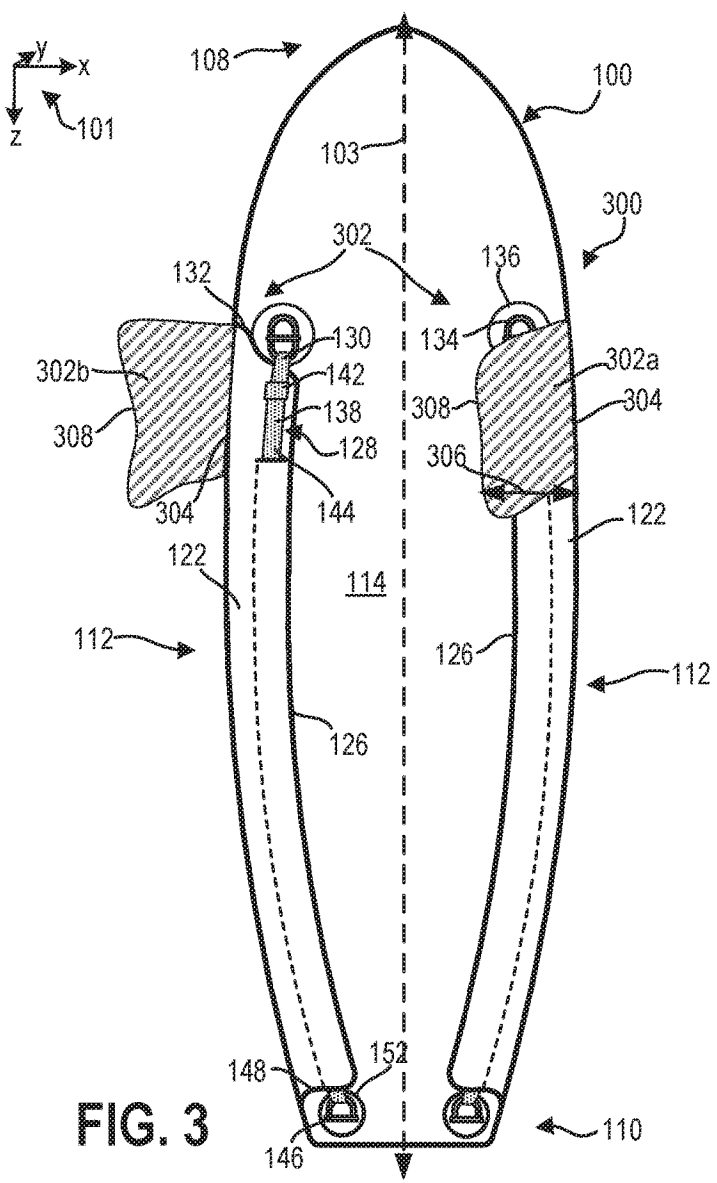
FIG. 3 is a top view of a second embodiment of a SUP with a binding system adapted with buckle covers.
Figures 5A, 5B, 5C:
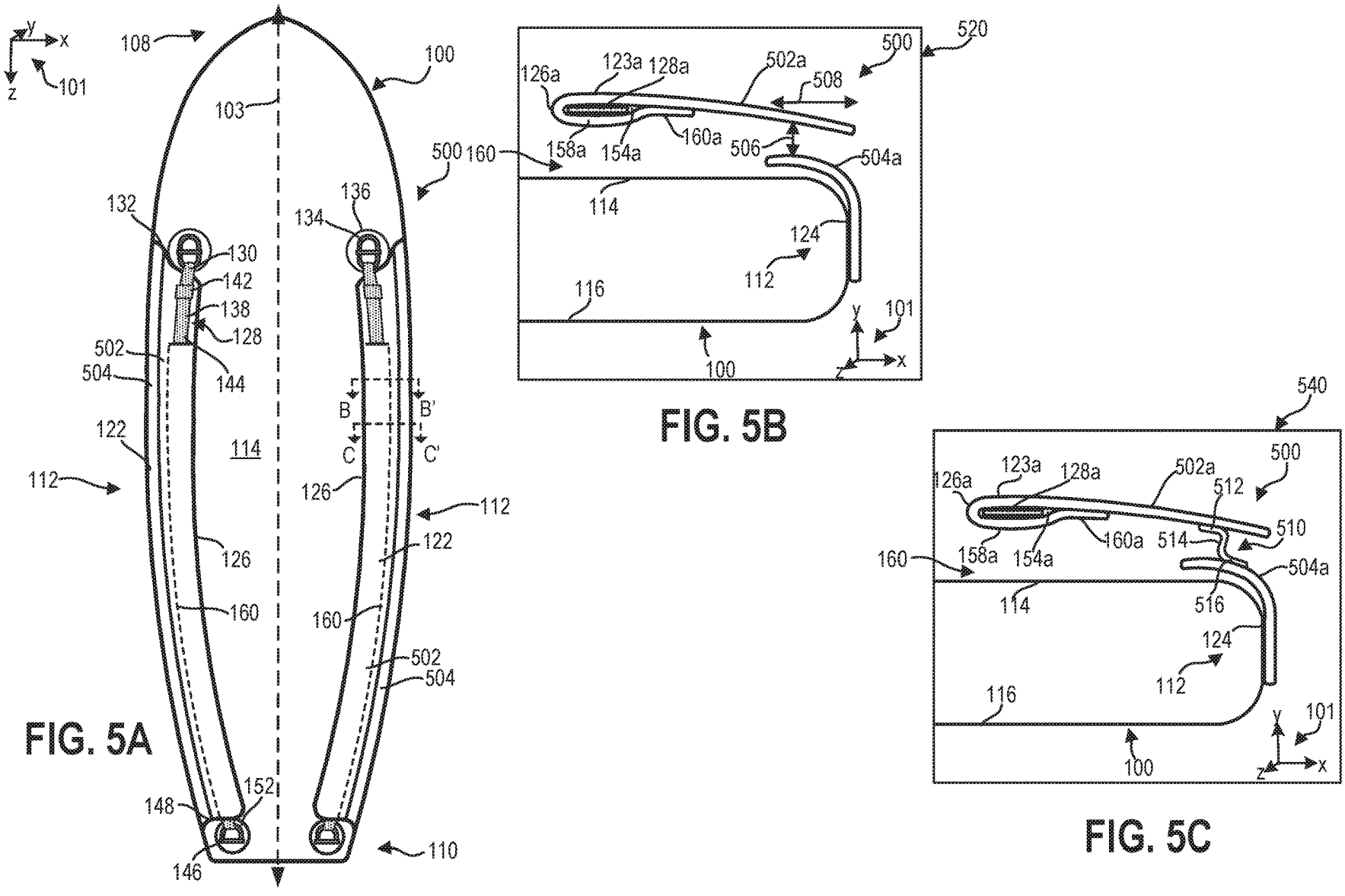
FIG. 5A is a top view of a fourth embodiment of a SUP with a binding system adapted with a second drainage system.
FIG. 5B is a first partial cross-section of the fourth embodiment of the SUP with the binding system adapted with the second drainage system.
FIG. 5C is a second partial cross-section of the fourth embodiment of the SUP with the binding system adapted with the second drainage system.

The following description relates to a binding system to secure placement of a user's feet on a stand-up paddleboard (SUP). The binding system comprises panels extending along a portion of a length of the SUP as well as extending alongside edges of the SUP, as shown in FIG. 1A. Tension on the panels may be generated by tightening straps extending across a length of the panels. A perspective view of a cross-section of the SUP, taken in a direction perpendicular to the length, is shown in FIG. 1B and a front view of the cross-section is shown in FIG. 1C. The panels of the binding system creates elongate pockets into which the user's feet may be inserted, as illustrated in FIG. 2. Top-down views of additional embodiments of the SUP are provided in FIGS. 3 and 4, showing the SUP adapted with flaps to cover cam buckles and drainage holes in the bindings to allow water to drain through the binding system. An alternate drainage system is shown in FIGS. 5A-5C, including cross-sections to illustrate a configuration of the drainage system. Further embodiments of the SUP are given in FIGS. 6-10B showing various optional features such as accessory loops for securing a paddle or fishing rod, handles for carrying the SUP, a grommet and lacing system for attaching the binding system to the SUP, adapting the binding system with storage compartments, and adding a front pocket as a barrier to forward sliding of the user's feet. An example of the binding system configured to be retrofitted to the SUP is shown in FIGS. 11A-11C, adapted as a removable binding system that may be adjusted to accommodate SUPs of different shapes and sizes. By including a binding system, either directly attached to the SUP, or retrofitted on the SUP, the user's balance may be more readily maintained and steering and control of the SUP may be more efficient by allowing the user's feet and hence the user's stance be braced against turbulent motion of the board. The additional features that the binding system may optionally comprise may expand the usage of the binding system to include, for example, securing and transport of objects, as well as ensuring drainage of the binding system, to further enhance an experience of the user while pursuing recreational water activities on the SUP.

A first embodiment of a stand-up paddleboard (SUP) 100 is illustrated in FIG. 1A. A set of reference axes 101 are provided for comparison between views, indicating a vertical "y" direction, horizontal "x" direction, and lateral "z" direction. The SUP 100 may be an elongate, rigid, planar structure with a central axis 103 aligned with the z direction about which the SUP 100 may be mirror-symmetric. A width 102 of the SUP 100, defined along the x direction, is less than a length 104, defined along the z direction, of the SUP 100, and both the width 102 and the length 104 are significantly greater than a thickness 106, defined along the y direction, of the SUP 100. The width 102 may be widest at a midpoint of the length 104 and taper to a rounded point at a bow 108 of the SUP 100. The width 102 may also taper slightly at a stern 110 of the SUP, imparting the SUP with a narrow nose, rounded sides 112 that curve outwards, along the x direction, away from the central axis 103, and a blunt tail.

It will be noted, however, that the embodiment of the SUP 100 shown in FIGS. 1A-11C is a non-limiting example and other geometries of the SUP 100 have been contemplated. In particular, another example may include a SUP with side edges adapted with a shallow sidecut arc. The side edges tapers inward towards the central axis of the SUP at a midpoint of a length. In yet another example, the SUP may have a tail shaped similar to a swallow-tail or be curved.

The SUP 100 has a top surface 114, hereafter referred to as a deck 114, and a bottom surface 116 that may be parallel and co-planar with a plane formed by the x and z directions. Alternatively, the deck 114 and bottom surface 116 may be co-planar with the plane formed by the x and z directions for a portion of the length 104 from the stern 110 to a mid-point between the stern 110 and the bow 108. The deck 114 and bottom surface 116 may curve slightly upwards from the mid-point to the bow 108 to reduce a surface area of the bottom surface 116 that is in contact with surrounding water, thereby reducing friction between the SUP 100 and the water. A rudder-like structure, also referred to as a fin 118, may be disposed in the bottom surface 116 of the SUP 100, proximal to the stern 110.

Furthermore, in one example, the thickness 106 of the SUP 100 may be uniform from the stern 110 to the bow 108. In another example, the thickness 106 may decrease from a mid-point along the length 104 of the SUP 100, such as at the mid-point where the deck 114 and bottom surface 116 may begin to curve upwards, to the bow 108 so that the bow 108 is thinner than the stern 110 of the SUP 100. It will be appreciated that other variations in dimensions and geometries of the SUP 100 may be envisioned without departing from the scope of the present disclosure.

The SUP 100 may be formed from a material or a combination of materials that provides a buoyancy of the SUP 100, even when supporting a user's weight. For example, the SUP 100 may have a polyurethane foam core enclosed by a fiberglass outer shell, a polystyrene foam core surrounded by an epoxy outer shell, or be formed from a hollow plastic casing. Alternatively, the SUP 100 may be formed of dense foam material coated with a less rigid, waterproof, outer coating, or the SUP 100 may be inflatable and formed from flexible materials such as PVC and rubber, or a drop-stitch fabric, thus allowing the SUP 100 to be folded and stored more compactly when deflated.

In this way, a user may stand on the deck 114 of the SUP 100 and use the SUP 100 as a flotation and transport device, as shown in FIG. 2, to navigate across or along bodies of water such as lakes, rivers, bays, etc. The buoyancy of the SUP 100, however, subjects the user to rocking or bouncing motions resulting from contact between the bottom surface 116 of the SUP 100 and a surface of moving water. In order to maintain balance, adjustment of the user's stance and foot placement may be desired. For example, the user may adopt a widened stance to lower the user's center of gravity. As the user's feet approach the sides 112 of the SUP 100, however, a likelihood of the user's feet sliding off the sides 112 may be increased, particularly during periods of high turbulence when water may spray or wash across the deck 114 and reduce traction between the user's feet and the deck 114. Turbulent water motion may also cause tilting of the SUP 100 and sliding of the user's feet. By adapting the SUP 100 with a binding system 120, the user's feet may be secured in desired positions without inhibiting adjustment of the user's foot placement in response to movement of the SUP 100. Furthermore, transfer of energy from the user's arms, when paddling the SUP 100, to the user's feet to control movement of the SUP 100 may be more increased, thereby allowing more powerful and efficient propulsion of the SUP 100. The binding system 120 shown in FIG. 1A includes panels 122 that may extend along each of the sides 112 across a portion of the length 104 of the SUP 100. The panels 122 may be a pair of flexible, elongate, flaps of material that wrap around the sides 112 and extend from side surfaces 124 (e.g., rails) of the SUP 100, the side surfaces 124 coupling the bottom surface 116 to the deck 114 of the SUP 100, toward the central axis 103 across portions of the width 102 of the SUP 100. The panels 122 may be glued or welded to the SUP 100 along the side surfaces 124. Inner, e.g., proximal to the central axis 103, edges 126 of the panels 122 may be co-axial with the central axis 103.

The binding system 120 may also include straps 128, formed from nylon or polyester, that extend along the inner edges 126 of the panels 122 co-axially with the central axis 103, with portions of the straps 128 enclosed within the panels 122 and external portions 138 of the straps 128 positioned on top of the panels 122. First ends 130 of the straps 128 that may be proximal to the bow 108 of the SUP 100 may extend a small distance beyond forward edges 132 of the panels 122 towards the bow 108. The first ends 130 may be coupled to a first set of D-rings 134 that may be attached to a first set of pads 136. The first set of pads 136 may be secured to the deck 114 at points between the forward edges 132 of the panels 122 and the bow 108 of the SUP 100 by glue or welding. As one example, the first set of D-rings 134 may be 1.5 inch inner diameter metal b-rings positioned, for example, 4 inches away from the sides 112 of the SUP 100, towards the central axis 103. The first set of pads 136 may be formed from rubber, PVC, or urethane.

The external portions 138 of the straps 128 extending towards the stern 110 from the first ends 130 may be arranged on top of the panels 122 and enter cavities of the panels 122 at slits 140 disposed in the panels 122. In one example, the slits 140 may be 2 inch wide openings to accommodate widths of the straps 128 that are equal to or less than 2 inches. In other examples, however, the slits 140 may be wider or narrower according to wider or narrower widths of the straps 128 and/or widths of the panels 122. Similarly, the first set D-rings 134 may have inner diameters larger or smaller than 0.5 inches in other embodiments of the SUP 100 and the D-rings 134 may be more or less than 4 inches from the sides 112.

The external portions 138 of the straps 128 may include cam buckles 142. The straps 128 may be wound through the cam buckles 142 to allow ratcheting of the straps 128 to tighten or loosen the straps 128 and to maintain a tension of the straps 128. Strap ends 144 may extend from the cam buckles 142, providing lengths of the straps 128 that may accommodate loosening of the straps 128. For example, tension of the straps 128 may be increased by pulling the strap ends 114, which may increase the lengths of the straps ends 144. The straps 128 may be loosened by feeding a portion of the lengths of the straps ends 144 through the cam buckles 142 in a forwards (e.g., towards the bow 108) direction, thereby decreasing the lengths of the strap ends 144 and increasing lengths of the straps 128 extending from the first set of D-rings 134 to a second set of D-rings 146 arranged proximal to the stern 110 of the SUP 100. The strap ends 144 may be tucked into the slits 140 to secure a position the strap ends 144, as shown in FIG. 1A.

The straps 128 may pass through the slits 140 to be enclosed within the panels 122 between the slits 140 and aft edges 148 of the panels 122, proximal to the stern 110 of the SUP 100. Second ends 150 of the straps 128 may emerge from the aft edges 148 of the panels 122 towards the stern 110 and couple to the second set of D-rings 146. The second set of D-rings 146 may be similar in size to the first set of D-rings 134 and also spaced away from the sides 112 of the SUP 100 by 4 inches. The second set of D-rings 146 may be secured in place by attachment to a second set of pads 152 that are similar to the first set of pads 136 and fixed to the deck 114 of the SUP 100 by glue or welding.

The straps 128 may be anchored at the first ends 130 to the deck 114 of the SUP 100 by coupling to the first set of D-rings 134 and first set of pads 136 and threaded through the second set of D-rings 146. The straps 128 may loop back towards the bow 108 of the SUP 100 through the panels 122 and emerge out of the panels 122 through the slits 140. The straps 128 may be threaded through the cam buckles 142 with the strap ends 144 extending away from the cam buckles. Adjustment of the lengths of the straps results in control of the tension in the straps 128 along the inner edges 126 of the panels 122. When the binding system 120 is not in use, or the SUP 100 is to be stored, increasing the tension on the straps 128 by pulling the strap ends 144 so that the lengths of the strap ends 144 increase may collapse or flatten the binding system 120 to decrease a profile of the binding system 120.

Further details of the binding system 120 are shown in a perspective view of a cross-section 170 of the SUP 100, taken along A-A' of FIG. 1A. Elements in common with those of FIG. 1A are similarly numbered in FIGS. 1B-11C and will not be re-introduced. The binding system, as described above, may be attached to the SUP 100 along the side surfaces 124 of the SUP 100. The side surfaces may be substantially co-planar with a plane formed by the y and z directions and may have a thickness that is less than the thickness 106 of the SUP 100 due to curvature of the sides 112, along the y direction, reducing a portion of a height of the sides 112 that is co-axial with the y direction, e.g., the thickness of the side surfaces 124.

The panels 122 may extend from a bottom edge, e.g., proximal to the bottom surface 116, of the side surfaces 124, up the side surfaces 124 and across portions of the width 102 of the SUP 100. The panels 122 are not attached to the deck 114 and are thus configured as a flap extending along a portion of the length 104. Upwards motion, or flapping, of the inner edges 126 of the panels 122 may be constrained by the straps 128 extending along the inner edges 126 and partially enclosed within cavities 154 of the panels 122.

The cavities 154 may extend from the slits 140, as shown in FIG. 1A, to the aft ends 148 of the panels 122. The cavities 154 may be formed from folding the inner edges 126 under the panels 122 and welding seams 160 along lengths of the cavities 154. A configuration of the cavities 154 is illustrated in further detail in FIG. 1C in an expansion 156 of a portion of the cross-section 170 of FIG. 1B.

The expansion 156 of FIG. 1C shows an expanded front view of a portion of the cross-section 170 of FIG. 1B, viewed along the z-direction towards the stern 110. A strap 128*a* is nested within one cavity 154*a* of the cavities 154 formed from a folded inner edge 126*a* so that the material of the panels 122 is folded underneath the strap 128*a*. The folding results in an arrangement of an outer layer 123*a* of the panels 122 above the strap 128*a* and an inner layer 158*a* of the panels 122 under the strap 128*a*, the outer layer 123*a* and the inner layer 158*a* formed from a continuous piece of material. An edge of the inner layer 158*a* is welded or glued to an inner surface of the outer layer 123*a* of the panels 122 to form a seam 160*a*. The binding system 120 includes two seams 160 that may extend across the length of the panels 122, forming narrow, elongate cavities 154 along the inner edges 126 to enclose portions of the straps 128. By attaching the panels 122 of the binding system 120 to the SUP 100 along the side surfaces 124 but allowing the inner edges 126 of the panels 122 to be free, e.g., not attached to the deck 114, the panels 122 form pockets 162 along the sides 112 of the SUP 100 that may secure positioning of the user's feet. The pockets 162 may be continuous along the length of the panels 122 thus allowing the user's feet to slide towards the bow 108 or stern 110 but not sideways, e.g. along the x direction, off the sides 112 of the SUP 100.

A front view 200 of the SUP 100 adapted with the binding system 120 is shown in FIG. 2 supporting a user's feet 202. The user 204 may stand on top of the deck 114 of the SUP 100 with the user's feet 202 spaced apart from one another so that the user's feet 202 are proximal to the sides 112 of the SUP 100. The feet 202 may be temporarily wedged under the inner edges 126 of the panels 122 into the pockets 162 and tension created by the straps 128 allows the panels 122 to resist upward and outward, e.g., away from the central axis 103 of FIG. 1A, forces exerted on the panels by the feet 202 as the user's weight shifts to accommodate rocking of the SUP 100 due to contact with a moving water surface 206. Motion of the user's feet 202 is constrained to forward and aft movement within the pockets 162 of the binding system 120 and along the inner edges 126 of the panels 122, providing multiple and continuous footholds for the user 204. The user 204 may utilize the tension generated by the straps 128 to brace the user's feet 202 while maintaining an upright stance of the user 204 and positioning of the feet 202 may be adjusted without uncontrolled sliding of the feet 202.

In this way, the user 204 may remain balanced while using a paddle 208 to propel the SUP 100 forwards (or backwards). The bracing of the user's feet 202 against the binding system 120 may also allow the user 204 to steer and maneuver the SUP 100 during turbulent conditions that result in tilting of the SUP 100. The user 204 may either press down with one of the user's feet 202 to counter the tilting or utilize the engagement of the user's feet with the binding system 120 to lift up one side of the board.

Furthermore the user 204 may readily alternate between using the binding system 120 for secured foot placement and placing the feet on top of the panels 122 when use of the binding system 120 is not desired, for example, during navigation in calm waters. The tension on the panels 122 generated by the straps 128 may be adjusted to allow the user's feet to be easily slid into the pockets 162 of the panels 122 and also collapse the pockets 162 so that a profile of the deck 114 of the SUP 100 is not substantially altered and the user 204 may comfortably stand on top of the panels 122. Thus the user's feet 202 may slide unhindered along a length of the panels 122 while wedged within the pockets 162 of the panels 122 but not outwards and away from the central axis of the SUP 100. The user's feet 202 may also be readily removed from the pockets 162 when desired since the binding system 120 does not include retentive devices attached to the user's feet 202.

In addition to securing the user's foot placement while balancing and/or steering the SUP, the binding system may be adapted with features to further improve efficiency of propulsion and steering of the SUP, transport of cargo and equipment on the SUP and transport of the SUP itself. As an example, another embodiment of a binding system 300 is shown in FIG. 3 that may include a set of protective flaps 302.

The set of protective flaps 302 may be approximately rectangular pieces of a padded material, such as neoprene, attached at outer edges 304 to the panels 122 of the binding system 300. The outer edges 304 may be coupled to the panels 122 along the sides 112 of the SUP 100 by glue, heat welding or stitching and may extend from the sides 112 towards the central axis 103 across a distance 306. The distance 306 may be a width, defined along the x direction, of the set of protective flaps 302 that allows the set of protective flaps 302 to cover the cam buckles 142 and the first set of D-rings 134 when the set of protective flaps 302 are in a closed position, such as shown by an arrangement of a first protective flap 302*a*. For example, if the first set of D-rings 134 is positioned 4 inches away from the sides 112 of the SUP 100 and the first set of D-rings 134 are 1 inch wide, the cam buckles 142 may be of similar widths and similarly spaced away from the sides 112 of the SUP 100. The set of protective flaps 302 may be at least 6 inches wide to provide full coverage of the cam buckles 142 and have lengths, defined along the z direction, at least as long as the external portions 138 of the straps 128.

The set of protective flaps 302 may be positioned along the sides 112 of the SUP 100 so that the set of protective flaps 302 are aligned with cam buckles 142. When the set of protective flaps 302 are in the closed position, as shown by the first protective flap 302*a*, the set of protective flaps 302 may be centered over the cam buckles 142 and directly on top of the cam buckles 142. The set of protective flaps 302 may be adjusted to an open position, as shown by a second protective flap 302*b*, by peeling the set of protective flaps 302 away from the central axis 103 at inner edges 308 of the set of protective flaps 302.

The set of protective flaps 302 may be secured in the closed position via a hook and loop mechanism or a heavy duty button closure (not shown) during active use of the SUP 100. By covering the cam buckles 142 with the set of protective flaps 302, contact between the user and the metallic cam buckles 142 may be softened by the positioning of the padded material of the set of protective flaps 302 in between. For example, during vigorous rocking of the SUP 100, the user may lose balance and stumble or fall on the deck 114 of the SUP 100 and the user's foot, knee or hand, or some other body part, may land on top of the cam buckles 142. However, the user's body part may not directly contact the cam buckles due to the presence of the set of protective flaps 302 arranged in the closed position. When adjustment of tension on the straps 128 is desired, the user may unfasten the mechanism holding the set of protective flaps 302 in the closed position and pull the set of protective flaps 302 to the open position to access the cam buckles 142 and strap ends 144.

In another embodiment of a binding system 400 for the SUP 100, shown in FIG. 4, the panels 122 may include a plurality of bail holes 402. The plurality of bail holes 402 may be circular apertures disposed in a region of the panels 122 between the seams 160 and the sides 112 of the SUP 100. The plurality of bail holes 402 may be evenly spaced apart along the length of the panels 122 and extend entirely through a thickness of the panels 122. Water that splashes onto the deck 114 of the SUP 100 may flow across the deck 114 towards the sides 112 into the pockets 162 of the panels 122 and drain out of the panels 122 through the plurality of bail holes 402. A likelihood of water accumulating in the pockets 162 of the panels 122 and decreasing traction between the user's feet and the deck 114 within the pocket 162, as well as adding weight to the SUP 100, is thereby reduced. It will be appreciated that the binding system 500 is a non-limiting example and different quantities, sizes, and shapes of the plurality of bail holes 402 have been contemplated.

An alternate embodiment of a binding system 500 configured to drain water from within the pockets 162 of the panels 122 is depicted in FIG. 5A. Therein, the panels 122 may comprise first shingles 502 that partially overlap with second shingles 504. The first and second shingles 502, 504 may be sections of the panels 122 that both extend along the length of the panels 122 but are each narrower than a total width of each flap of the panels 122. The first shingles 502 may include the inner edges 126 and the seams 160 of the panels 122 and may not be in contact with surfaces of the SUP 100. The second shingles 504 may be attached to the side surfaces 124 of the SUP 100. The first shingles 502 may be positioned above the second shingles 504 and offset from the second shingles 504 so that a portion of a width, defined along the x direction, of the first shingles 502 overlaps with a portion of a width of the second shingles 504. The first shingles 502 may be connected to the second shingles 504 by connectors, described further below with respect to FIG. 5C, positioned along the overlapping area between the first and second shingles 502, 504.

The positioning of the first shingles 502 relative to the second shingles 504, as well as an arrangement of connectors coupling the first shingles 502 to the second shingles 504 are shown in greater detail in FIGS. 5B and 5C. FIG. 5B is a first cross-section 520 taken along B-B' of FIG. 5A and viewed along the z direction towards the bow 108 of the SUP 100. The first cross-section 520 shows a first shingle 502*a* positioned above a second shingle 504*a*, the first shingle 502*a* partially overlapping with the second shingle 504*a* across a distance 508. The first shingle 502*a* is spaced vertically (e.g., along the y direction) away from the second shingle 504*a* by a gap 506. The gap 506 may be analogous to the bail holes 402 of FIG. 4, allowing water to drain out of the pockets 162 of the panels 122.

The first shingle 502*a* may be attached to the second shingle 504*a* by a connector 510, shown in a second cross-section 540 of FIG. 5C, taken along C-C' of FIG. 5A. The second cross-section 540 may be taken from a different region of the binding system 500 from the first cross-section 520, coinciding with where the connector 510 is positioned, whereas the first cross-section 520 is taken from a region in between the connector 510 and another adjacent connector. In other words, a plurality of connectors, similar to the connector 510, may be disposed along the overlapping region between the first shingles 502 and the second shingles 504 in the gap 506 and spaced apart from one another along the z direction. The gap 506 may comprise a plurality of openings, or slots, with each slot bound by the first shingle 502*a* above, the second shingle 504*a* below, and on either side by the connector 510 and an adjacent connector. The connector 510 may be formed from a "z"-shaped piece of material that may be a same material as the panels 122. A first section 512 of the connector 510 may be co-planar with the first shingle 502*a* and attached to a bottom surface of the first shingle 502*a* by glue or welding. The first section 512 may be coupled to a third, co-planar section 516 of the connector 510 by a second section 514 that is vertically aligned. The third section 516 may be glued or welded to an upper surface of the second shingle 504*a*.

By adapting the binding system 500 with the overlapping first and second shingles 502, 504 that are connected via connectors such as the connector 510, water may be drained from the panels 122 while an integrity of the binding system 500 is maintained. Thus water may be rapidly emptied from the pockets 162 of the panels 122 without compromising a securing of the user's feet within the binding system 500.

Figure 7:
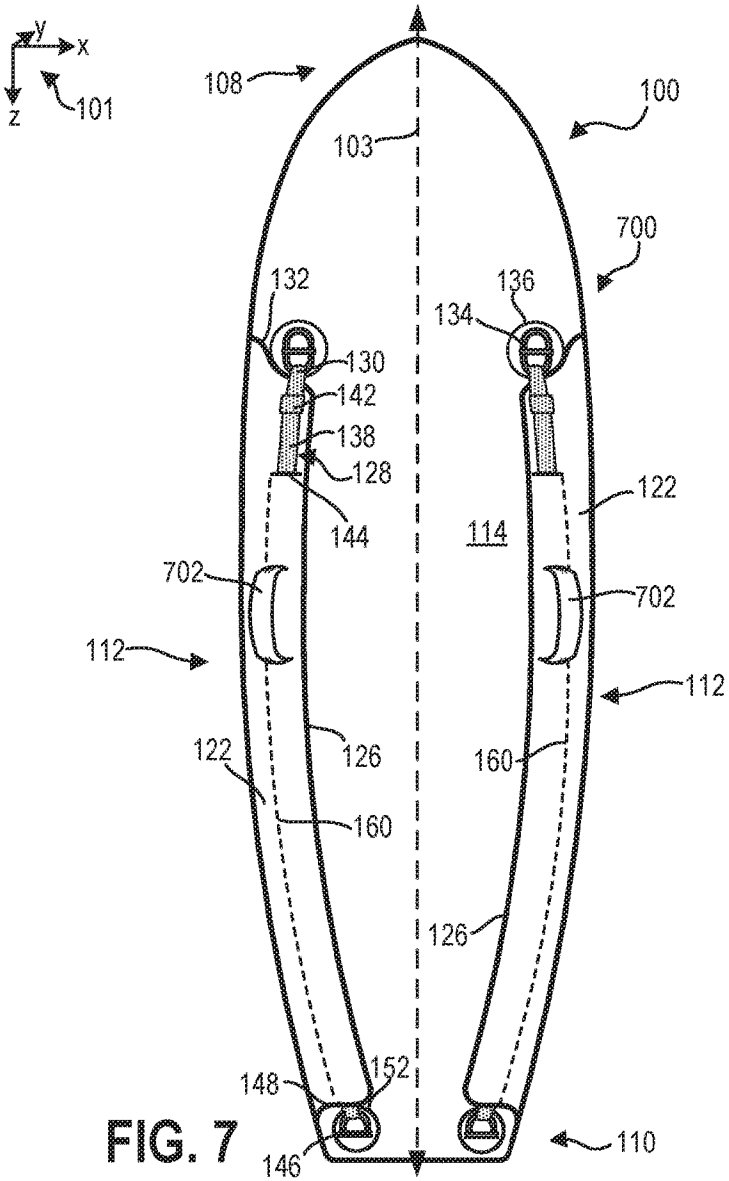
FIG. 7 is a top view of a sixth embodiment of a SUP with a binding system adapted with handles.
Figure 6:
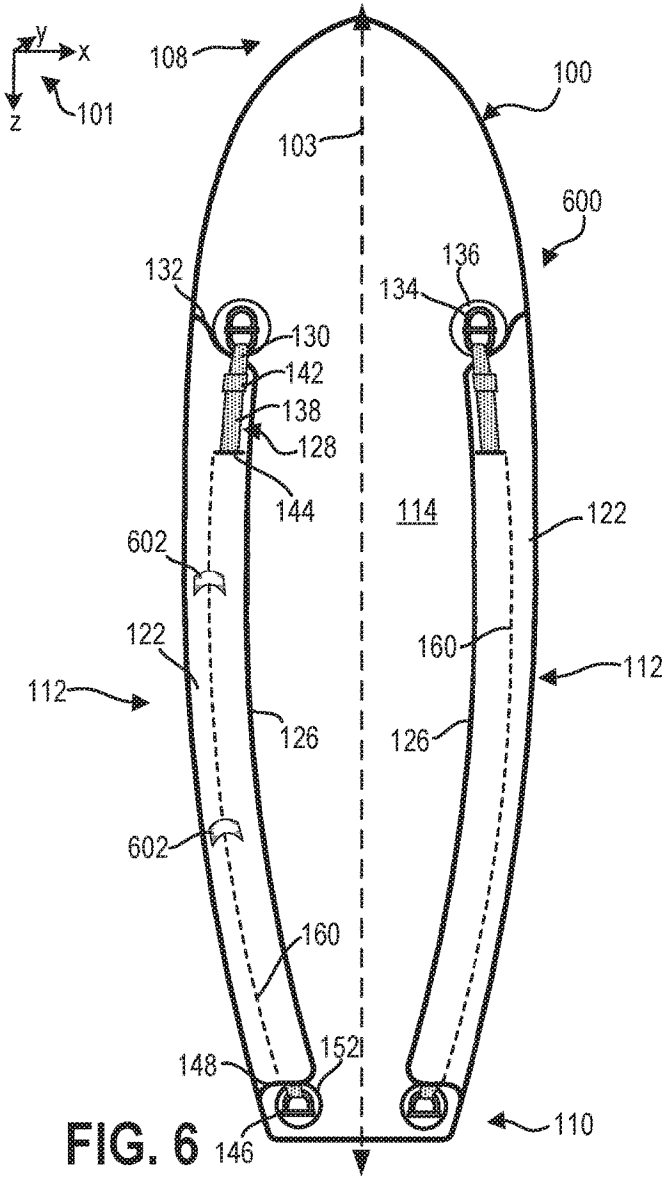
FIG. 6 is a top view of a fifth embodiment of a SUP with a binding system adapted with accessory loops.

Turning now to FIGS. 6 and 7, a binding system for the SUP 100 may be adapted with optional features for attaching objects to the binding system or for easier transport and handling of the SUP 100. For example, an embodiment of a binding system 600 provided in FIG. 6 shows a set of accessory loops 602 coupled to a flap of the panels 122. The set of accessory loops 602 may be attached to the panels 122 by glue or welded at ends of each loop of the set of accessory loops 602 so that the set of accessory loops 602 forms semi-circular protrusions, when viewed from along the z direction, from upper surfaces of the panels 122.

The set of accessory loops 602 may be used to secure elongate objects such as a paddle, e.g., the paddle 208 of FIG. 2, or a fishing rod, by feeding the object through the set of accessory loops 602. Alternatively, objects may be tied to the set of accessory loops 602. In some embodiments, the accessory loops may be configured as hook and loop attachments that may be opened up to wrap around an object and secure the object by closing the loops via Velcro or some other securing device. Furthermore, while the set of accessory loops 602 shown in FIG. 6 includes two loops disposed on one flap of the panels 122, other examples may include variations in the number and positioning of the set of accessory loops 602. For example, the set of accessory loops 602 may include 3, 4, or 6 loops, or both flaps of the panels 122 may be adapted with the set of accessory loops 602.

Handles 702 may also be attached to the panels 122, as shown in another embodiment of a binding system 700 in FIG. 7. The handles 702 may be similar to the set of accessory loops 602 of FIG. 6 but may be larger loops to accommodate insertion of the user's hands. However, the handles 702 may be configured to be too small for the user's feet to slide into the handles 702. Each flap of the panels 122 may include one of the handles 702 which may be attached by glue or welding. The handles 702 may also protrude upwards from the panels 122 and allow the user to carry or manipulate the SUP 100 by holding the handles 702. The user may alternatively carry the SUP 100 by aligning the SUP 100 horizontally so that the central axis 103 is parallel with the x direction and the SUP 100 is co-planar with the x-z or y-z plane. The user may be positioned against the deck 114 of the SUP 100 with one flap of the panels 122 that is at an upper end of the SUP 100 when the SUP 100 is turned horizontally, may be positioned on the user's shoulder. The user's shoulder bears a weight of the SUP 100 and the position of the SUP 100 may be stabilized by the user gripping one of the external portions 138 of the straps 128.

Both the set of accessory loops 602 and the handles 702 may be formed from a same material as the panels 122 or the straps 128. In another embodiment of a binding system 800, shown in FIG. 8, the binding system 800 may configured to be removable by adapting a grommet and lacing system 802 instead of gluing or welding the panels 122 to the side surfaces 124 of the SUP 100. The grommet and lacing system 802 may include a strip of grommets 804 comprising a piece of PVC or urethane with grommets, formed from metal, plastic, or rubber, reinforcing apertures extending through a thickness of the strip of PVC or urethane.

The panels 122 may be adapted with lacing 806, formed from twine, nylon, or polyester string, attached to outer edges 808 of the panels 122. The lacing 806 may be wound through the grommets of the strip of grommets 804 and tied, thereby attaching the panels 122 to the strip of grommets 804 along the outer edges 808 of the panels 122. The panels 122 may be detached from the strip of grommets 804 by untying and unwinding the lacing 806. In this way, the binding system 800 may be removed from the SUP 100 when use of the binding system 800 is not desired or when transfer of the panels 122 to another SUP is demanded.

Figure 9B:
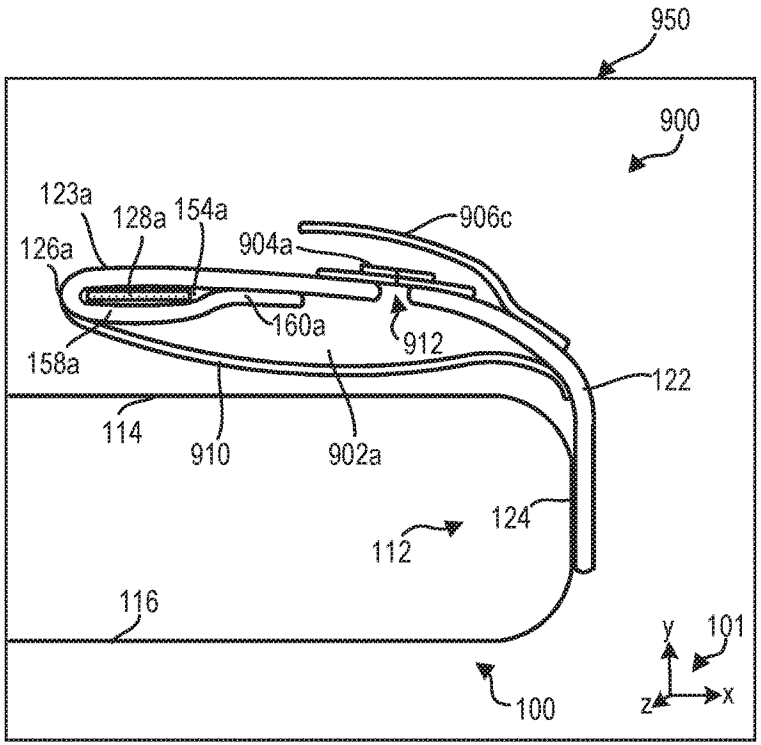
FIG. 9B is a partial cross-section of the eighth embodiment of the SUP with the binding system adapted with storage compartments.
Figure 9A:
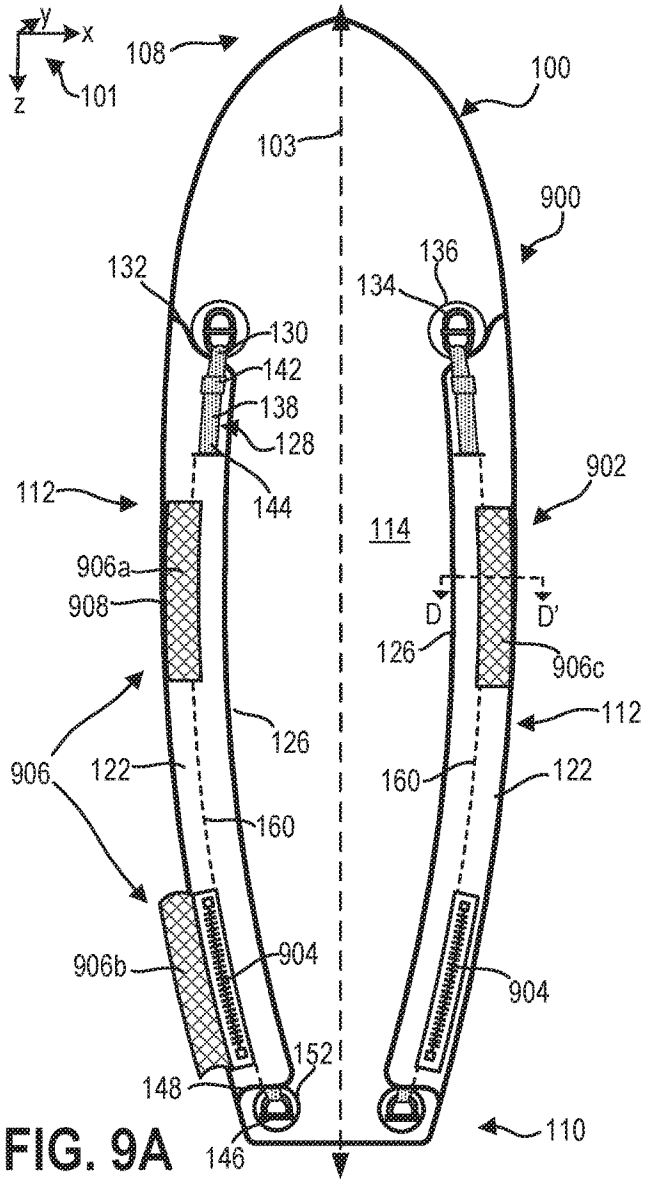
FIG. 9A is a top view of an eighth embodiment of a SUP with a binding system adapted with storage compartments.

Another embodiment of a binding system 900 may include storage compartments 902 integrated into the panels 122 of the binding system 900 as shown in FIGS. 9A-9B. The panels 122 may be adapted with waterproof zippers 904 that may be openings to the storage compartments 902. The zippers 904 may be positioned in the panels 122 between the seams 160 and the sides 112 of the SUP 100. The zippers 904 may be configured with zipper covers 906 which may be used similarly to the set of protective flaps 302 of FIG. 3.

The zipper covers 906 may be approximately rectangular in shape and have dimensions, e.g., a length and a width, matching those of the zippers 904 so that the zippers 904 may be fully covered when the zipper covers 906 are in a closed position, shown by a first zipper cover 906*a*. The zipper covers 906 may be fixed to the panels 122 along outer edges 908 of the zipper covers 906 so that the zipper covers 906 may be adjusted to an open position to allow access to the zippers 904, as shown by a second zipper cover 906*b*, while remaining attached to the panels 122 at the outer edges 908. The zipper covers 906 may be formed from a waterproof material such as PVC or urethane to assist in reducing water seepage into the storage compartments 902 through the zippers 904.

The storage compartments 902 may be cavities integrated into the panels 122 by configuring the flaps of the panels 122 with additional layers of material. An arrangement of a storage compartment 902*a* within the panels 122 is shown in a cross-section 950 of FIG. 9B, taken along D-D' of FIG. 9A. The storage compartment 902*a* may include a bottom layer 910 of a waterproof material, such as PVC or urethane, that seals the storage compartment 902*a* between the inner edge 126*a* of the panels 122 and a point along the panels 122 proximal to the sides 112 of the SUP 100. An opening 912 in the panels 122 may also be an opening of the storage compartment 902*a* and may be aligned with a zipper 904*a* so that when the zipper 904*a* is opened, objects may be inserted into or removed from the storage compartment 902*a* through the opening 912 and the storage compartment 902*a* may be sealed by closing the zipper 904*a*.

Accessories such as tools, snacks, clothing, etc., may thereby be stored on the SUP 100 and maintained relatively dry by integrating the binding system 900 with the storage compartments 902 that may be sealed via the waterproof zippers 904 and the zipper covers 906. An amount or size of objects that may be stored within the storage compartments 902 may depend on dimensions of the storage compartments 902. The dimensions of the storage compartments 902 may vary according to a number and a placement of the storage compartments 902. For example, other embodiments of the binding system 900 may include two large storage compartments 902 with one storage compartment disposed in each flap of the panels 122. In other examples, the binding system 900 may be adapted with 3 or 4 smaller storage compartments 902 per flap of the panels 122 or include storage compartments 902 in one flap of the panels 122 and not the other.

Figure 10B:
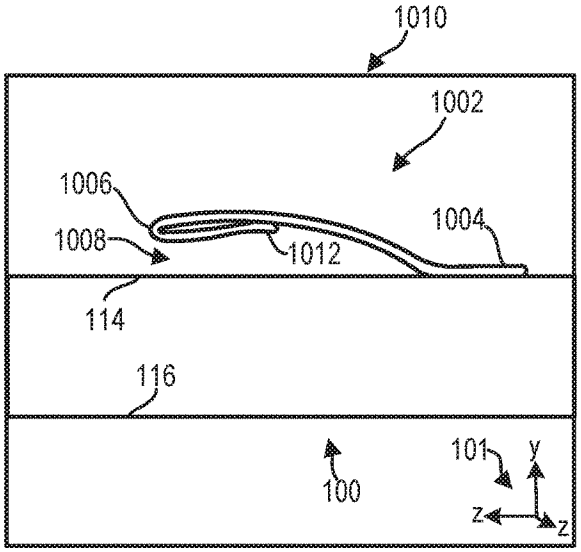
FIG. 10B is a partial cross-section of the tenth embodiment of the SUP with the binding system adapted with the front pocket.
Figure 10A:
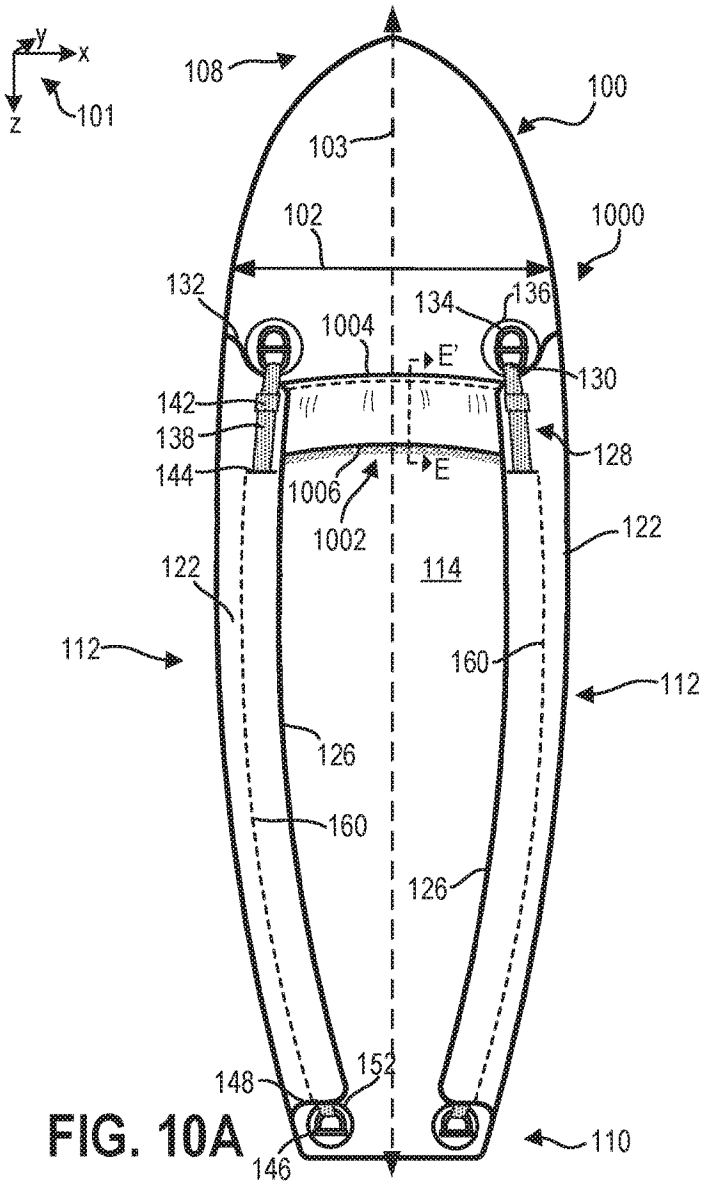
FIG. 10A is a top view of a tenth embodiment of a SUP with a binding system adapted with a front pocket.
Figure 11B:
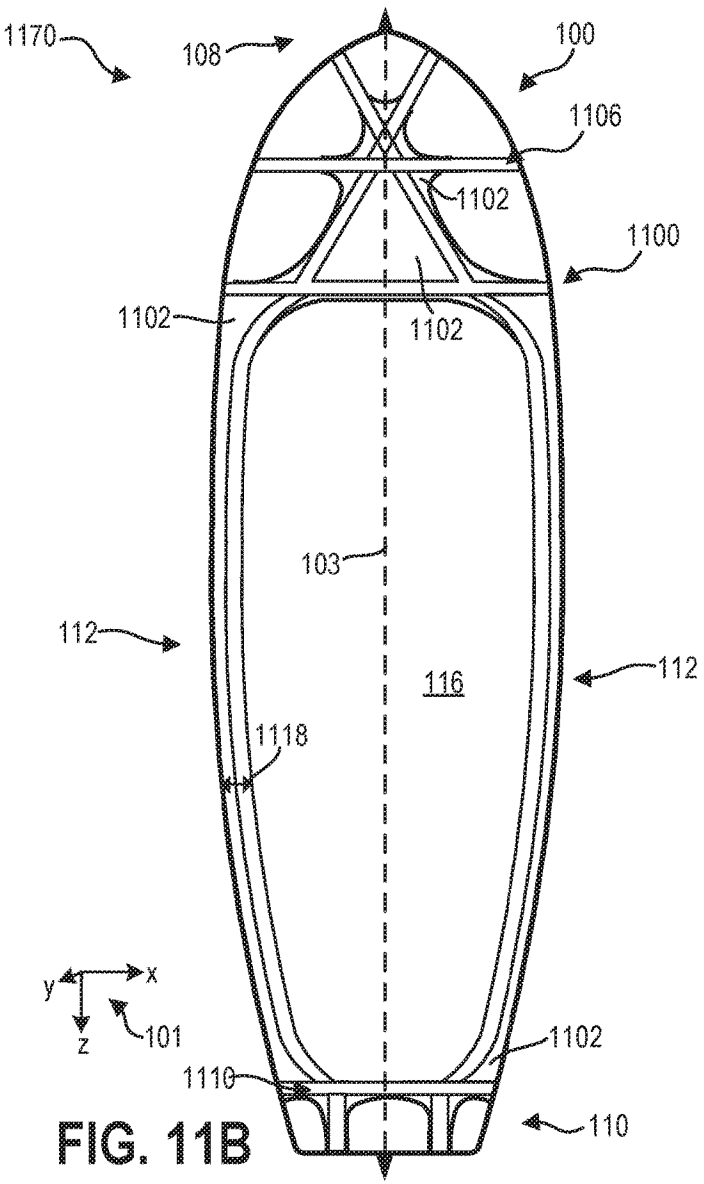
FIG. 11B is a first bottom view of the ninth embodiment of the SUP with the retrofit binding system.
Figure 11A:
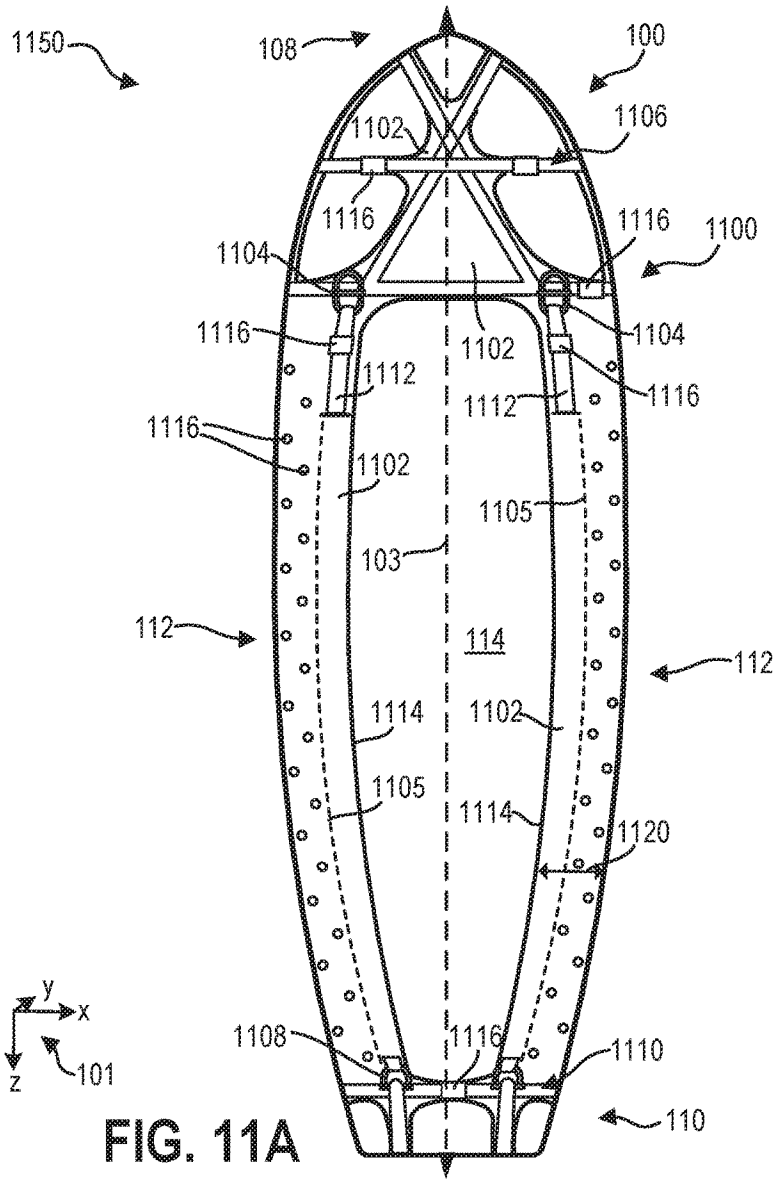
FIG. 11A is a top view of a ninth embodiment of a SUP with a retrofit binding system.
Figure 11C:
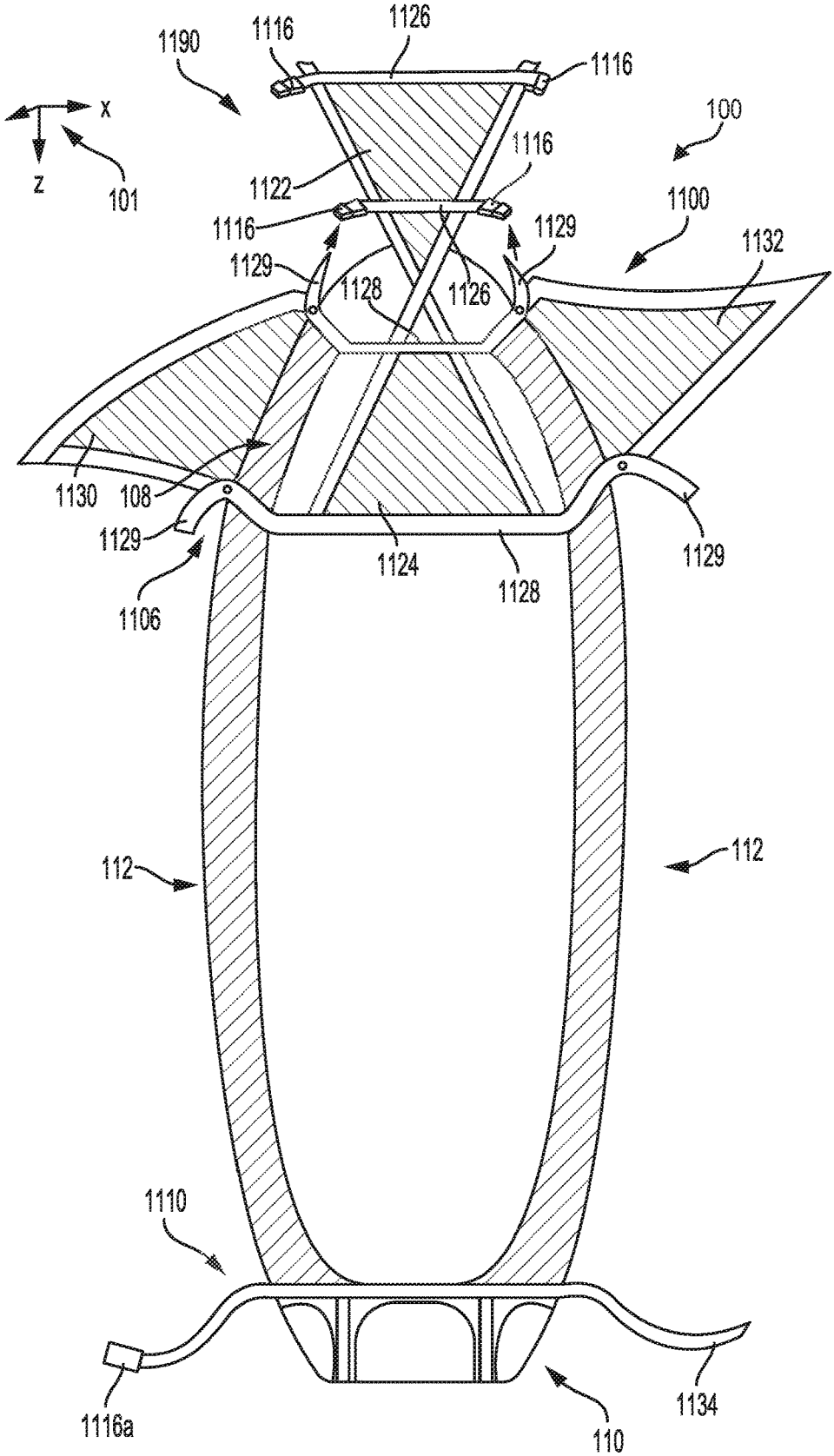
FIG. 11C is a second bottom view of the ninth embodiment of the SUP with the retrofit binding system in an unfastened configuration.

A binding system for the SUP 100 may also include a front pocket 1002, illustrated in an embodiment of a binding system 1000 in FIGS. 10A and 10B. A top-down view of the SUP 100 and binding system 1000 shows the front pocket 1002 aligned perpendicular to the panels 122, extending across the width 102 of the SUP 100 and under the panels 122 at regions where the front pocket 1002 overlap with the panels 122. The front pocket 1002 may be formed from a strip of material, such as PVC or urethane, and aligned proximal to the forward edges 132 of the panels 122.

The front pocket 1002 may be attached to the deck 114 of the SUP 100 by glue or welding along a forward border 1004 of the front pocket 1002. An aft border 1006 of the front pocket 1002 may not be attached to the deck 114, forming a forward pocket 1008, shown in FIG. 10B, that is similar to the pockets 162 of the panels 122. An arrangement of the front pocket 1002 relative to the deck 114 of the SUP 100 may be viewed in greater detail in a cross-section 1010 of FIG. 10B, taken along E-E' of FIG. 10A. The cross-section 1010 shows that the material of the front pocket 1002 may be folded under, similar to the inner edges 126 of the panels 122, along the forward border 1004 and the folding maintained by gluing or welding the folding along a folded edge 1012 of the front pocket 1002.

The front pocket 1002 may be configured to secure the placement of the user's feet, similar to the panels 122 of the binding system 1000, but along a longitudinal direction, e.g., along the central axis. The user's feet may be secured in a forward position on the deck 114 of the SUP 100 inside the forward pocket 1008 of the front pocket 1002, thus providing a barrier to the user's feet from sliding any further forwards. The user's feet, and stance, may be braced by the front pocket 1002 when the user moves towards the bow 108 of the SUP 100 by inserting at least one foot into the forward pocket 1008. Adjusting tension of the straps 128 may also affect a tension of the front pocket 1002 over the user's feet.

Figure 8:
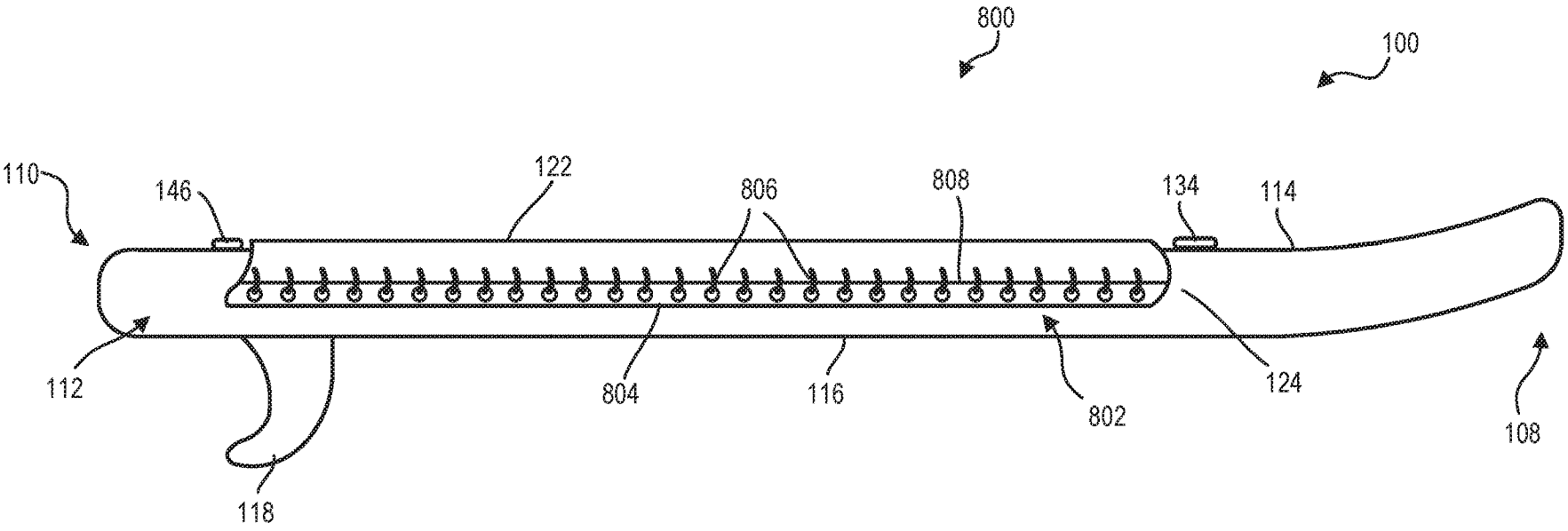
FIG. 8 is a side view of a seventh embodiment of a SUP with a binding system adapted with a grommet and lacing system for attaching or detaching the binding system to the SUP.

The binding systems of FIGS. 1A-10B describe embodiments that are either permanently fixed to the SUP 100 or comprise at least one set of components that remain constantly attached to the SUP 100, e.g., the strip of grommets 804 of FIG. 8. However, a binding system that may be entirely removable may be desirable. Furthermore, a removable binding system that may be adjusted to fit another SUP of different dimensions and/or geometry may allow the user to apply a single binding system to multiple SUPs, thereby reducing equipment costs to the user. An example of a retrofit binding system 1100 is shown in FIGS. 11A-11C that may be retrofitted to the SUP 100 using a network of adjustable straps and buckles.

A top view 1150 of the SUP 100 is depicted in FIG. 11A, adapted with the retrofit binding system 1100 that includes panels 1102 that extends along the sides 112 of the SUP 100, similar to the panels 122 of FIGS. 1A-10B. The panels 1102 of the retrofit binding system 1100, may be a single, continuous piece of material that, in addition to extending along the sides 112 and across portions of the width of the SUP 100 from the sides 112, also extends towards the bow 108 of the SUP 100. A plurality of bail holes 1103 may be disposed in the panels 1102 between seams 1105 of the panels 1102 and sides 112 of the SUP 100, providing drainage of water pooling within pockets of the panels 1102. The plurality of bail holes may be arranged in a staggered pattern along a length of the panels 1102.

The retrofit binding system 1100 may continue along the sides 112 of the SUP 100 forwards (e.g., towards the bow 108) of a first set of D-rings 1104 as well as forwards through a central region of the deck 114 of the SUP 100. The portion of the retrofit binding system 1100 covering the central region of the deck 114 forwards of the first set of D-rings 1104 may be shaped to match a forward network of straps 1106 that assists in securing the panels 1102 to the SUP 100 at a bow end of the SUP 100. The portion of the retrofit binding system 1100 forwards of the first set of D-rings 1104 may provide padding between the forward network of straps 1106 and surfaces of the SUP 100 to allow tightening of the forward network of straps 1106 without the forward network of straps 1106 rubbing directly against the surfaces of the SUP 100.

The retrofit binding system 1100 may also extend aftwards, towards the stern 110 of the SUP 100, between a second set of D-rings 1108 and the stern 110 of the SUP 100. The portion of the retrofit binding system 1100 extending aftwards of the second set of D-rings 1108 may be shaped to match and provide padding under an aftward network of straps 1110 that assists in securing the retrofit binding system 1100 to the SUP 100 at a stern end of the SUP 100. The first and second set of D-rings may be 1.5 inch diameter metal D-rings and the straps of the forward network of straps 1106, aftward network of straps 1110, and foothold straps 1112 may be 1.5 inch wide straps formed from nylon or polyester.

The panels 1102 may comprise the foothold straps 1112, similarly configured to the straps 128 of FIGS. 1A-7 and FIGS. 9A-10B, anchored to and extending between the first set of D-rings 1104 and the second set of D-rings 1108, and partially enclosed within the panels 1102 along inner edges 1114 of the panels 1102. The foothold straps 1112, the forwards network of straps 1106, and aftwards network of straps 1110 may be adapted with cam buckles 1116 to adjust tension on the panels 1102. The cam buckles 1116 on the foothold straps 1112 may allow tension on the foothold straps 1112 to resist sideways (e.g., along the x direction) and vertical (e.g., along the y direction) motion of a user's feet when the user's feet are inserted into pockets formed by the panels 1102. The cam buckles 1116 on the forward network of straps 1106 and aftward network of straps 1110 allow a tightening and loosening of the networks of straps to either secure the retrofit binding system 1100 to the SUP 100 or remove the retrofit binding system 1100 from the SUP 100.

The panels 1102 may wrap around the sides 112 of the SUP and extend from the sides 112 a distance 1118 across the bottom surface 116 of the SUP 100 along the x direction, as shown in a first bottom view 1170 of the SUP 100 and retrofit binding system 1100 of FIG. 11B. In one example, the distance 1118 of extension of the panels 1102 across the bottom surface 116 may be less than a distance 1120 of extension of the panels 1102 across the deck 114 of the SUP 100 from the sides 112. In other examples, the distance 1118 the panels 1102 extends from the sides 112 across the bottom surface 116 may be similar to the distance 1120 the panels 1102 extends from the sides 112 across the deck 114.

The forward network of straps 1106 and forward portion of the retrofit binding system 1100 may continue to wrap around the sides 112 of the SUP 100 and have a similar geometry along the bottom surface 116 of the SUP 100, as shown in FIG. 11B, as along the deck 114, as shown in FIG. 11C. The aftward network of straps 1110 may also continue around the sides 112 and stern 110 of the SUP 100 and share a similar geometry across the bottom surface 116 of the SUP as across the deck 114. In this way, the retrofit binding system 1100 may be configured as a net that wraps around the SUP 100, secured in place by the cam buckles 1116 and straps.

The fitting of the retrofit binding system 1100 to the SUP 100 is further illustrated in FIG. 11C in a second bottom view 1190 of the SUP 100. The retrofit binding system 1100 is depicted unfastened, e.g., not secured around the SUP 100, in FIG. 11C with the retrofit binding system 1100 in the forward and aftward regions of the SUP 100 and forward and aftward networks of straps 1106, 1110, splayed open. The unfastened position of the retrofit binding system 1100 shows that the forward portion of the retrofit binding system 1100, covering the central region of the deck 114, may comprise three overlapping panels, all substantially triangular in shape.

A first triangular panel 1122 of the overlapping forward portion of the retrofit binding system 1100 may extend along the z direction in the unfastened position, with a point of the triangle proximal to the bow 108 of the SUP 100 and a base of the triangle distal to the bow 108. The first triangular panel 1122 may be bordered by straps of the forward network of straps 1106 which may extend around the sides 112 of the SUP 100 to the bottom surface 116, connecting the first triangular panel 1122 to a bottom panel 1124 of the forward portion of the retrofit binding system 1100 via the straps. The first triangular panel may also include a first set of horizontal straps 1126 adapted with the cam buckles 1116, with the straps of the first set of horizontal straps 1126 spaced apart from one another, while the bottom panel 1124 includes a similarly spaced apart second set of horizontal straps 1128. The second set of horizontal straps 1128 may extend around the sides 112 of the SUP 100, coupled to forward edges of the retrofit binding system 1100 traversing the sides 112, and include strap tails 1129.

A second triangular panel 1130 may be attached to the retrofit binding system 1100 along one side of the sides 112 of the SUP 100 by the straps of the forward network of straps 1106. The second triangular panel 1130 may be similar in size to the first triangular panel 1122 and a third triangular panel 1132 may be a mirror image of the second triangular panel 1130, similarly attached to the retrofit binding system 1100 along a side of the SUP 100 opposite of the side to which the second triangular panel 1130 is attached, via straps of the forward network of straps 1106.

The SUP 100 may be fitted with the retrofit binding system 1100 by inserting the stern 110 of the SUP 100 into the aftward portion of the retrofit binding system 1100 and the aftward network of straps 1110. An aftward strap tail 1134 may be threaded through a cam buckle 1116*a* disposed in the aftward network of straps 1110 and used to tighten the aftward network of straps 1110 around the SUP 100 by increasing a length of the aftward strap tail 1134 by pulling the aftward strap tail 1134 in a first direction. Loosening of the aftward network of straps 1110 may be achieved by feeding the strap tail 1134 through the cam buckle 1116*a* in a second, opposite, direction so that the length of the strap tail 1134 extending from the cam buckle 1116*a* is decreased.

Closing and securing of the retrofit binding system 1100 around the bow 108 end of the SUP 100 may be achieved by arranging the bottom panel 1124 against the bottom surface 116 of the SUP 100 and positioning the second triangular panel 1130 on the deck 114 of the SUP. The third triangular panel 1132 may be placed directly above and in face-sharing contact with the second panel 1130 and first triangular panel 1122 arranged directly above and in face-sharing contact with the third triangular panel 1132 so that the three triangular panels 1122, 1130, and 1132 are stacked and the edges of each panel aligned. Alternatively, the third triangular panel 1132 may be placed directly on top of the deck 114, the second triangular panel 1130 arranged on top of the third triangular panel 1132, and the first triangular panel 1122 positioned on top of the second triangular panel 1130.

The strap tails 1129 may be threaded through the cam buckles 1116 of the forward network of straps 1106 and pulled along the first direction to tighten the forward network of straps 1106 around the SUP 100 so that lengths of the strap tails 1129 extending from the cam buckles 1116 are increased. To loosen the forward network of straps 1106, the strap tails 1129 may be fed through the cam buckles 1116 in the second direction so that the lengths of the strap tails 1129 extending from the cam buckles 1116 are decreased. To remove the retrofit binding system 1100 from the SUP 100, the strap tails 1129 may be pulled out of the cam buckles entirely to release the overlapping first, second and third triangular panels 1122, 1130, and 1132, and allow the SUP 100 to be freed from the retrofit binding system 1100.

As described above, in one example, the panels 1102, forward and aftward portions of the retrofit binding system 1100 may be formed from a single continuous material, such as PVC, rubber, or urethane, with narrowed regions of the panels 1102 adapted to be slightly wider than the straps of the forward and aftward networks of straps 1106, 1110, as well as regions of the retrofit binding system 1100 with large surface areas, such as the first, second, and third triangular panels 1122, 1130, and 1132. In other examples, however, the retrofit binding system 1100 may be continuous but formed from more than one material to incorporate materials with different desirable physical properties. For example, a durable material such as urethane may be used in the retrofit binding system 1100 along the sides 112 of the SUP 100 and a more elastic material such as neoprene may be used at the bow and stern ends of the SUP to accommodate different shapes of the SUP 100 at the bow 108 and stern 110. The sections of neoprene may be sewed or glued to the urethane section to maintain a continuity of the retrofit binding system 1100.

It will be appreciated that while the features of each embodiment of the SUP described in FIGS. 1A-11C are shown separately, other examples of the SUP may comprise numerous combinations of the depicted features. For example, the binding system may be adapted with storage compartments and accessory loops and protective flaps to cover the cam buckles. The binding system may be attached to the SUP via the grommet and lacing system and include handles attached to the panels. As yet another example, the retrofit binding system may include overlapping shingles instead of bail holes for drainage or include storage compartments. Any combination of the various embodiments shown may be envisioned without departing from the scope of the present disclosure.

FIGS. 1A-11C show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

In this way, a user's balance and steering efficiency when navigating a body of water on a stand-up paddleboard (SUP) may be improved. By adapting the SUP with a binding system that provides multiple continuous footholds alongside edges of the SUP, the user's feet may be braced against the binding system, resisting horizontal outwards and upwards movement of the user's feet so the user may more easily maintain an upright, balanced stance and control the SUP. The user's feet, inserted into pockets formed by panels of the binding system, may slide unhindered longitudinally along a deck of the SUP, thereby improving how the user's weight may be distributed along the SUP while a likelihood of the user losing balance is reduced. In addition the user's feet may be easily removed unhindered from the pockets when desired. The user's recreational experience may be further enhanced by adapting the binding system with additional features such as accessory loops for stowing a paddle or fishing rod, zippered storage compartments for waterproof storage, handles for more convenient carrying, and flaps to pad metal buckles of the binding system. Furthermore, the binding system may be configured to be partially or fully removable and retrofitted to another SUP, thereby allowing the binding system to be adapted to SUPs of varying shapes and sizes.

In one embodiment, a binding system for a water craft comprises panels extending alongside edges of the watercraft, tensioning members interfacing respectively with the panels and adjustably tensioning the panels, pockets respectively formed by the panels, between the panels and a surface of the watercraft, shaped to allow a user's foot to be temporarily wedged therein and further to allow the user's foot to slide along the edges while engaged in the pockets. In a first example, the binding system includes the watercraft configured as a paddleboard. A second example of the binding system optionally includes the first example, and further includes wherein the tensioning members are straps, partially enclosed by the panels, and extending longitudinally across a length of the watercraft and along inner edges of the panels. A third example of the binding system optionally includes one or more of the first and second examples, and further includes, wherein a profile of the pockets, protruding upwards from the surface of the watercraft, is adjustable based on tension provided by the straps. A fourth example of the binding system optionally includes one or more of the first through third examples, and further includes, wherein the pockets include continuous openings along a full length of the panels along edges of the panels proximal to a central axis of the watercraft. A fifth example of the binding system optionally includes one or more of the first through fourth examples, and further includes, wherein a first portion of the straps are arranged external to and above the panels, and a second portion of the straps are enclosed in a fold along the inner edges of the panels, the fold sealed by a seam. A sixth example of the binding system optionally includes one or more of the first through fifth examples, and further includes, wherein the first portion includes first ends of the straps that are anchored to a first set of D-rings attached to the deck of the paddleboard proximal to the bow and the second portion includes portions of the straps looped through a second set of D-rings attached to the deck of the paddleboard proximal to the stern and threaded through cam buckles arranged along the first portion of the straps. A seventh example of the binding system optionally includes one or more of the first through sixth examples, and further includes, wherein increasing tension provided by the straps is generated by pulling strap ends along a first direction through cam buckles to tighten the straps and releasing tension from the straps is achieved by feeding the strap ends through the cam buckles in an opposite second direction to loosen the straps. An eighth example of the binding system optionally includes one or more of the first through seventh examples, and further includes, wherein positioning a user's feet inside the pockets constrains movement of the feet to a longitudinal direction along a length of the panels.

In another embodiment, a paddleboard includes a binding system coupled to the paddleboard including, panels extending as two flaps alongside edges of the paddleboard and along a portion of a length of the paddleboard, straps anchored to a surface of the SUP, interfacing with the panels and adjustably tensioning the panels, pockets formed from the flaps of the panels, shaped to allow a user's feet to be temporarily wedged therein, allowing the user's feet to slide along the side edges of the paddleboard while engaged in the pockets and allowing the user's feet to be easily removed from the pockets. In a first example of the paddleboard the binding system is adapted with protective flaps attached to the panels aligned with cam buckles of the straps and configured to cover the cam buckles and a set of D-rings, positioned between the cam buckles and a bow of the paddleboard, when in a closed position. A second example of the paddleboard optionally includes the first example, and further includes wherein the binding system is adapted with bail holes disposed in the panels between the straps and the side edges of the paddleboard to allow water accumulated in the pockets to drain out through the bail holes. A third example of the paddleboard optionally includes one or more of the first and second examples, and further includes, wherein the panels of the binding system are adapted with first shingles that overlap with second shingles, with vertical gaps in between the first singles and the second shingles, the first shingles coupled to the second shingles by a plurality of connectors that are spaced apart, and wherein water collecting in the pockets of the panels drains out through a plurality of slots in the gaps, each slot of the plurality of slots bordered by the first and second shingles and one of the plurality of connectors and an adjacent connector of the plurality of connectors. A fourth example of the paddleboard optionally includes one or more of the first through third examples, and further includes, wherein the binding system is adapted with accessory loops attached to the panels for securing equipment to the paddleboard. A fifth example of the paddleboard optionally includes one or more of the first through fourth examples, and further includes, wherein the binding system is adapted with handles attached to the panels for carrying and maneuvering the paddleboard. A sixth example of the paddleboard optionally includes one or more of the first through fifth examples, and further includes, wherein the binding system comprises a grommet and lacing system including a strip of grommets attached to the side edges of the paddleboard and removable panels that is coupled to the strip of grommets by lacing the removable panels to the strip of grommets. A seventh example of the paddleboard optionally includes one or more of the first through sixth examples, and further includes, wherein the binding system includes integrated storage compartments, the integrated storage compartments formed from cavities disposed in the panels with openings of the storage compartments sealed shut by waterproof zippers. An eighth example of the paddleboard optionally includes one or more of the first through seventh examples, and further includes, wherein the waterproof zippers are adapted with zipper covers that entirely cover the waterproof zippers when in a closed position and allow access to the waterproof zippers when in an open position. A ninth example of the paddleboard optionally includes one or more of the first through eighth examples, and further includes a front pocket arranged across the width of the SUP, proximal to forward edges of the panels and positioned under the panels in regions where the front pocket and panels overlap, the front pocket attached to the deck of the paddleboard along a forward edge of the front pocket and forming a pocket between an aftward edge of the front pocket and the deck of the paddleboard.

In another embodiment, a kit for a watercraft includes panels configured to be securely attached alongside edges of the watercraft, and tensioning members for interfacing respectively with the panels and adjustably tensioning the panels.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A binding system for a watercraft, comprising:

panels extending alongside edges of the watercraft;

tensioning members interfacing respectively with the panels and adjustably tensioning the panels; and pockets respectively formed by the panels, between the panels and a surface of the watercraft, shaped to allow a user's foot to be temporarily wedged therein and further to allow the user's foot to slide along the edges while engaged in the pockets.

2. The binding system of claim 1, wherein the watercraft is a paddleboard.

3. The binding system of claim 1, wherein the tensioning members are straps, partially enclosed by the panels, and extending longitudinally across a length of the watercraft and along inner edges of the panels.

4. The binding system of claim 3, wherein a profile of the pockets, protruding upwards from the surface of the watercraft, is adjustable based on tension provided by the straps.

5. The binding system of claim 4, wherein the pockets include continuous openings along a full length of the panels along edges of the panels proximal to a central axis of the watercraft.

6. The binding system of claim 3, wherein a first portion of the straps are arranged external to and above the panels, and a second portion of the straps are enclosed in a fold along the inner edges of the panels, the fold sealed by a seam.

7. The binding system of claim 6, wherein the first portion includes first ends of the straps that are anchored to a first set of D-rings attached to a deck of the watercraft proximal to a bow and the second portion includes portions of the straps looped through a second set of D-rings attached to the deck of the watercraft proximal to a stern and threaded through cam buckles arranged along the first portion of the straps.

8. The binding system of claim 1, wherein increasing tension provided by the straps is generated by pulling strap ends along a first direction through cam buckles to tighten the straps and releasing tension from the straps is achieved by feeding the strap ends through the cam buckles in an opposite second direction to loosen the straps.

9. The binding system of claim 1, wherein positioning a user's feet inside the pockets constrains movement of the feet to a longitudinal direction along a length of the panels.

10. A paddleboard, comprising:

a binding system coupled to the paddleboard, including, panels extending as two flaps alongside edges of the paddleboard and along a portion of a length of the paddleboard;

straps anchored to a surface of the paddleboard, interfacing with the panels and adjustably tensioning the panels; and pockets formed from the flaps of the panels, shaped to allow a user's feet to be temporarily wedged therein, allowing the user's feet to slide along side edges of the paddleboard while engaged in the pockets and allowing the user's feet to be easily removed from the pockets.

11. The paddleboard of claim 10, wherein the binding system is adapted with protective flaps attached to the panels aligned with cam buckles of the straps and configured to cover the cam buckles and a set of D-rings, positioned between the cam buckles and a bow of the paddleboard, when in a closed position.

12. The paddleboard of claim 10, wherein the binding system is adapted with bail holes disposed in the panels between the straps and the side edges of the paddleboard to allow water accumulated in the pockets to drain out through the bail holes.

13. The paddleboard of claim 10, wherein the panels of the binding system are adapted with first shingles that overlap with second shingles, with vertical gaps in between the first singles and the second shingles, the first shingles coupled to the second shingles by a plurality of connectors that are spaced apart, and wherein water collecting in the pockets of the panels drains out through a plurality of slots in the gaps, each slot of the plurality of slots bordered by the first and second shingles and one of the plurality of connectors and an adjacent connector of the plurality of connectors.

14. The paddleboard of claim 10, wherein the binding system is adapted with accessory loops attached to the panels for securing equipment to the paddleboard.

15. The paddleboard of claim 10, wherein the binding system is adapted with handles attached to the panels for carrying and maneuvering the paddleboard.

16. The paddleboard of claim 10, wherein the binding system comprises a grommet and lacing system including a strip of grommets attached to the side edges of the paddleboard and removable panels that are coupled to the strip of grommets by lacing the removable panels to the strip of grommets.

17. The paddleboard of claim 10, wherein the binding system includes integrated storage compartments, the integrated storage compartments formed from cavities disposed in the panels with openings of the storage compartments sealed shut by waterproof zippers.

18. The paddleboard of claim 17, wherein the waterproof zippers are adapted with zipper covers that entirely cover the waterproof zippers when in a closed position and allow access to the waterproof zippers when in an open position.

19. The paddleboard of claim 10, further comprising a front pocket arranged across a width of the paddleboard, proximal to forward edges of the panels and positioned under the panels in regions where the front pocket and the panels overlap, the front pocket attached to a deck of the paddleboard along a forward edge of the front pocket and forming a pocket between an aftward edge of the front pocket and the deck of the paddleboard.

* * * * *